US009267367B2

(12) United States Patent
Wheeler et al.

(10) Patent No.: US 9,267,367 B2
(45) Date of Patent: Feb. 23, 2016

(54) METHOD FOR STEAM ASSISTED GRAVITY DRAINAGE WITH PRESSURE DIFFERENTIAL INJECTION

(75) Inventors: Thomas J. Wheeler, Houston, TX (US); Daniel R. Sultenfuss, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 485 days.

(21) Appl. No.: 13/432,954

(22) Filed: Mar. 28, 2012

(65) Prior Publication Data

US 2012/0273195 A1 Nov. 1, 2012

Related U.S. Application Data

(60) Provisional application No. 61/478,984, filed on Apr. 26, 2011.

(51) Int. Cl.

| | |
|---|---|
| ***E21B 43/24*** | (2006.01) |
| ***E21B 43/16*** | (2006.01) |
| ***E21B 36/00*** | (2006.01) |

(52) U.S. Cl.

CPC ..... *E21B 43/2408* (2013.01); *E21B 43/168* (2013.01); *E21B 43/24* (2013.01)

(58) Field of Classification Search

CPC . E21B 43/2406; E21B 43/2408; E21B 43/24; E21B 43/16; E21B 43/241; E21B 43/168

See application file for complete search history.

(56) References Cited

U.S. PATENT DOCUMENTS

| | | | | |
|---|---|---|---|---|
| 6,318,464 | B1 * | 11/2001 | Mokrys | 166/252.1 |
| 7,527,096 | B2 | 5/2009 | Chung et al. | |
| 7,621,326 | B2 | 11/2009 | Crichlow | |
| 2006/0289157 | A1 | 12/2006 | Rao | |
| 2007/0181299 | A1 * | 8/2007 | Chung et al. | 166/245 |
| 2009/0218099 | A1 | 9/2009 | Hart et al. | |

FOREIGN PATENT DOCUMENTS

| | | |
|---|---|---|
| WO | WO2009014586 | 1/2009 |
| WO | WO2010059288 | 5/2010 |
| WO | WO2010062208 | 6/2010 |

OTHER PUBLICATIONS

Stalder, John L., "Unlocking Bitumen in Thin and/or Lower Pressure Pay Using Cross-SAGD (XSAGD)," ConocoPhillips Canada (2006), 13 pgs.

* cited by examiner

*Primary Examiner* — Zakiya W Bates

(74) *Attorney, Agent, or Firm* — ConocoPhillips Company

(57) ABSTRACT

A process for recovering hydrocarbons with steam assisted gravity drainage (SAGD) with pressure differential injection. Methods for producing hydrocarbons in a subterranean formation having at least two well pairs include installing a highest pressure well pair in the subterranean formation; installing a lowest pressure well pair in the subterranean formation; applying a pressure differential across the highest pressure well pair and the lowest pressure well pair; injecting steam into the first injection well to form a first steam chamber; injecting steam into the final injection well to form an adjacent steam chamber; monitoring the steam chambers until they merge into a final steam chamber; ceasing the flow of steam into the first injection well; and injecting steam into the final injection well to maintain the final steam chamber.

11 Claims, 4 Drawing Sheets

METHOD FOR STEAM ASSISTED GRAVITY DRAINAGE WITH PRESSURE DIFFERENTIAL INJECTION

CROSS-REFERENCE TO RELATED APPLICATIONS

This application claims priority benefit under 35 U.S.C. Section 119(e) to U.S. Provisional Patent Ser. No. 61/478,984 filed on Apr. 26, 2011 the entire disclosure of which is incorporated herein by reference.

FIELD OF THE INVENTION

Embodiments of the invention relate to a process for recovering hydrocarbons with steam assisted gravity drainage (SAGD) with pressure differential injection.

BACKGROUND OF THE INVENTION

Heavy hydrocarbons in the form of petroleum deposits are distributed worldwide and the heavy oil reserves are measured in the hundreds of billions of recoverable barrels. Because of the relatively high viscosity, which can exceed $10^6$ cp, these crude deposits are essentially immobile and cannot be easily recovered by conventional primary and secondary means. The only economically viable means of oil recovery is by the addition of heat to the oil deposit, which significantly decreases the viscosity of the oil by several orders of magnitude and allows the oil to flow from the formation into the producing well.

Steam assigned gravity drainage (SAGD) utilizes two parallel and superposed horizontal wells vertically separated by approximately 5 meters. The process is initiated by circulating steam in both of the wells to heat the heavy oil/bitumen between the wellpair via conduction until mobility is established and gravity drainage can be initiated. During gravity drainage, steam is injected into the top horizontal well and oil and condensate are produced from the lower well.

SAGD is one of the commercial processes that allows for the in-situ recovery of bitumen. SAGD, as an in-situ recovery process, requires steam generation and water treatment, which translates into a large capital investment in surface facilities. Since water-cuts (produced water to oil ratios) are high and natural gas is used to generate steam, the process suffers from high operating costs (OPEX). To compound these issues, the product, heavy oil or bitumen, is sold at a significant discount to WTI, providing a challenging economic environment when companies decide to invest in these operations.

Theses conditions limit the resource that can be developed to those with a reservoir thickness typically greater than 15-20 meters. The primary driver behind this limit is the steam-to-oil ratio, that is, the volume of steam as water, which is required to produce 1 $m^3$ or 1 bbl of oil. During the recovery process, a wellpair must be drilled and spaced such that it has access to sufficient resources to pay out the capital and operating costs. During the SAGD process, heat is transferred to the bitumen/heavy oil, as well as the produced fluids and overburden and underburden. In thinner reservoirs, economics do not allow wells to access sufficient resources, primarily due to high cumulative steam oil ratio (CSOR). A rule of thumb applied by the SAGD industry is SOR of 3.0 to 3.5 as the economic limit. This of course will vary from project to project.

Therefore, a need exits for enhancements in the SAGD process that can minimize the inefficiencies of the process, while maintaining or improving the economic recovery.

SUMMARY OF THE INVENTION

In an embodiment of the present invention, a method for producing hydrocarbons in a subterranean formation having at least two well pairs includes: (a) installing a highest pressure well pair in the subterranean formation, wherein the highest pressure well pair includes a first injection well and a first production well, wherein the pressure differential across the first injection well and an adjacent injection well is at least 200 kPa; (b) installing a lowest pressure well pair in the subterranean formation, wherein the lowest pressure well pair includes a final injection well and a final production well, wherein the pressure differential across the final injection well and an adjacent injection well is at least 200 kPa; (c) applying a considerable pressure differential across the highest pressure well pair and the lowest pressure well pair, wherein the considerable pressure differential across the highest pressure and lowest pressure well pairs is at least 200 kPa; (d) injecting steam into the first injection well to form a first steam chamber; (e) injecting steam into the final injection well to form an adjacent steam chamber; (f) monitoring the steam chambers until they merge into a final steam chamber; (g) ceasing the flow of steam into the first injection well; and (h) injecting steam into the final injection well to maintain the final steam chamber.

In another embodiment of the present invention, a method for producing hydrocarbons in a subterranean formation having at least two well pairs includes: (a) installing a highest pressure well pair in the subterranean formation, wherein the highest pressure well pair includes a first injection well and a first production well; (b) installing a lowest pressure well pair in the subterranean formation, wherein the lowest pressure well pair includes a final injection well and a final production well; (c) applying a considerable pressure differential across the highest pressure well pair and the lowest pressure well pair; (d) injecting steam into the first injection well to form a first steam chamber; (e) injecting steam into the final injection well to form a final steam chamber; (f) monitoring the steam chambers until they merge into a final steam chamber; (g) ceasing the flow of steam into the first injection well; and (h) injecting steam into the final injection well to maintain a final steam chamber.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

Reference will now be made in detail to embodiments of the present invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used in another embodiment to yield a still further embodiment. Thus, it is intended that the present invention cover such modifications and variations that come within the scope of the appended claims and their equivalents.

Figure 1:
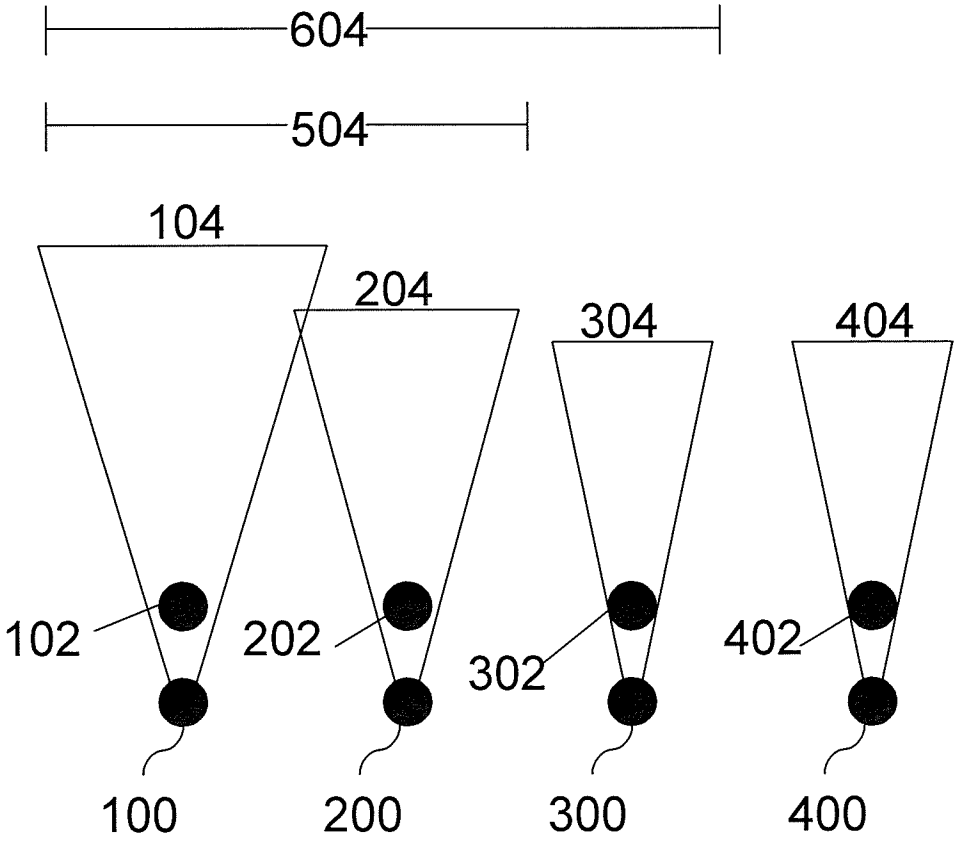
FIG. 1 is a schematic depiction of a pad of SAGD well pairs in accordance with the present invention.

Referring to FIG. 1, a pad of SAGD well pairs are depicted. Four SAGD well pairs are depicted in FIG. 1, however, the number of well pairs within reservoir is dependent on operator need so long as at least two SAGD well pairs are present. Each well pair includes an injection well and an associated production well. FIG. 1 depicts production wells 100, 200, 300 and 400 and associated injection wells 102, 202, 302 and 402.

The production wells are generally completed low in the reservoir below the injection wells, with the production wells being in sufficient proximity to the injection wells to ensure fluid communication between the injection wells and the production wells. In particular, the production wells evacuate oil in the formation as the oil is heated and becomes mobile. Preheating the formation around the injection wells with steam, for example, may facilitate establishing initial communication between the injection wells and the production wells.

In operation, a considerable pressure differential is applied across the pad to encourage flow from the injection well to the production well. The considerable pressure differential is formation dependent, but must be at least 1000 kPa across the pad. However, the considerable pressure differential across contiguous well pairs, i.e., two adjacent well pairs, must be at least 200 kPa. The considerable pressure differential applied across the pad can be measured according to the steam injection pressure at the first injection well as compared to the steam injection pressure at the final injection well. Thus, the steam injection pressure at the first injection well should be significantly greater than the steam injection pressure at the final injection well. The significant pressure differential across the pad encourages lateral growth of steam chambers 104, 204, 304 and 404 promoting coalescence.

In an embodiment, solvent can be co-injected with steam. In another embodiment, noncondensable gases can be co-injected with the steam. The noncondensable gases can include methane, nitrogen, carbon-dioxide, air, light hydrocarbon solvents or combinations thereof. Light hydrocarbons can include propane and butane. In another embodiment, solvent can be co-injected with the steam and the use of non-condensable gases.

In FIG. 1, steam chamber 104 coalescences with chamber 204 to form steam chamber 504. Upon formation of steam chamber 504, injection well 102 is shut-in and the pressure in the system, i.e., amalgamated steam chamber 504, is decreased to the injection pressure of well 202, which creates a steam drive toward well 100. Injection well 202 then promotes gravity drainage in steam chamber 204, and induces steam-drive recovery in production well 100. Steam chamber 504 coalesces with steam chamber 304 to form steam chamber 604. Upon formation of steam chamber 604, injection well 202 is shut-in and the pressure in the system is decreased. Injection well 302 then promotes gravity drainage in steam chamber 304, and induces steam-drive recovery in production well 200. Steam chamber 604 coalescences with steam chamber 404 to from steam chamber 704. Upon the formation of steam chamber 704, injection well 302 is shut in and the pressure in the system is decreased. Injection well 402 then promotes gravity drainage in steam chamber 404 and induces steam-drive recovery in production well 300.

Figure 2:
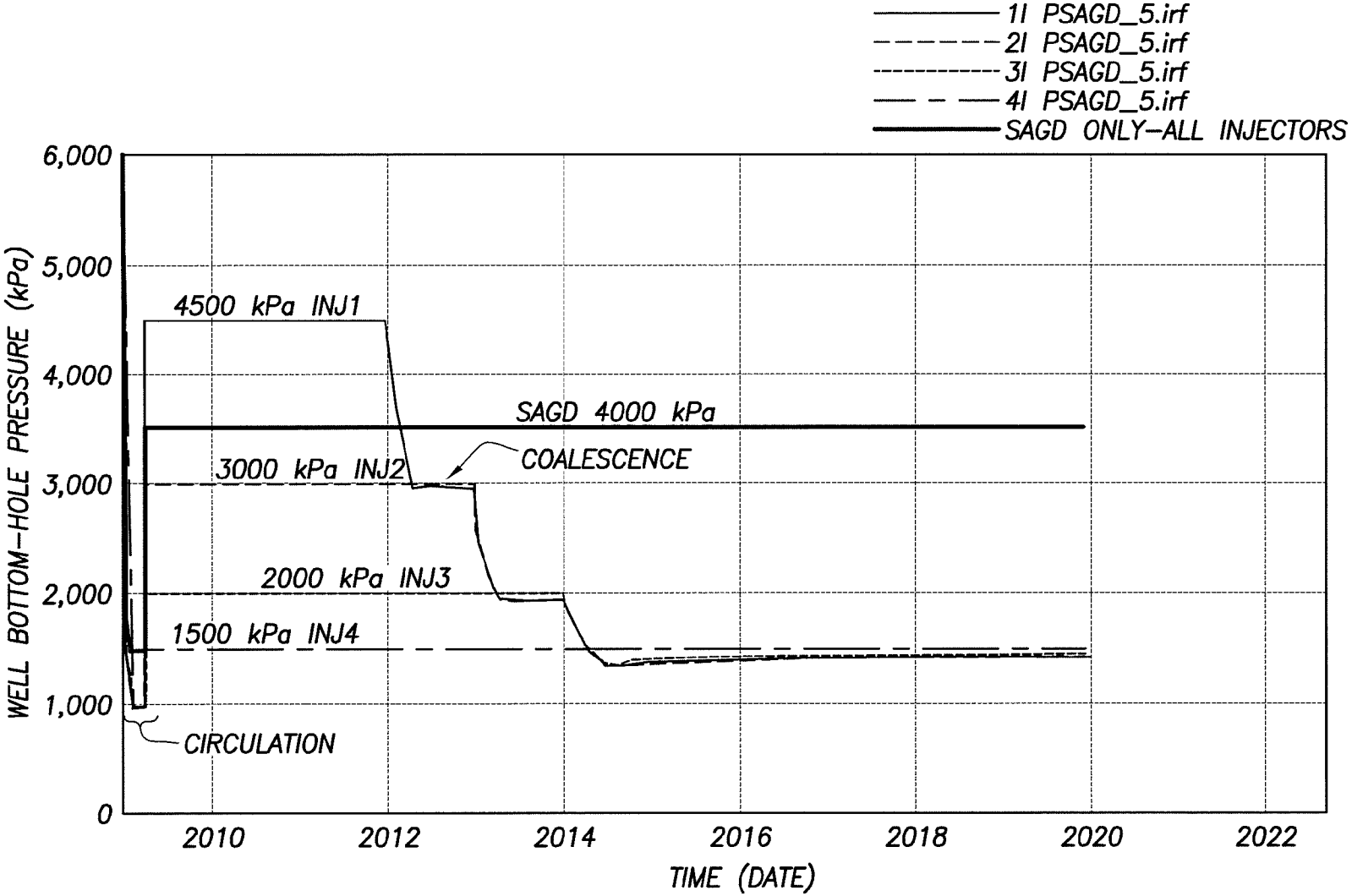
FIG. 2 is a pressure versus time graph of an example of a pad of SAGD well pairs in accordance with the present invention.

FIG. 2 provides an example of the effects of a significant pressure differential between four well pairs as compared to a standard well with a constant steam injection pressure of 4000 kPa. In FIG. 2, the steam injection pressure of the first injection well is 4500 kPa, resulting in the formation of a first steam chamber. The steam injection pressure of a second injection well is 3000 kPa, resulting in the formation of a second steam chamber. The steam injection pressure of a third injection well is 2000 kPa, resulting in the formation of a third steam chamber. Finally, the injection pressure of a fourth injection well is 1500 kPa, resulting in the formation of a fourth steam chamber.

In FIG. 2, the pressure of the first steam chamber is decreased by 1500 kPa and then coalescences with the second steam chamber to form a first combined steam chamber. Upon formation of the first combined steam chamber, the first injection well is shut-in and the pressure of the first combined steam chamber begins to decrease. The second injection well then promotes gravity drainage in the second steam chamber, and induces steam-drive recovery in the first producer well. When the pressure in the first combined steam chamber decreases by 1000 kPa, then the first combined steam chamber coalescences with the third steam chamber to form a second combined steam chamber. Upon formation of the second combined steam chamber, the second injection well is shut-in and the pressure of the second combined steam chamber begins to decrease. The third injection well then promotes gravity drainage in the third steam chamber, and induces steam-drive recovery of the second producer well.

Figure 3:
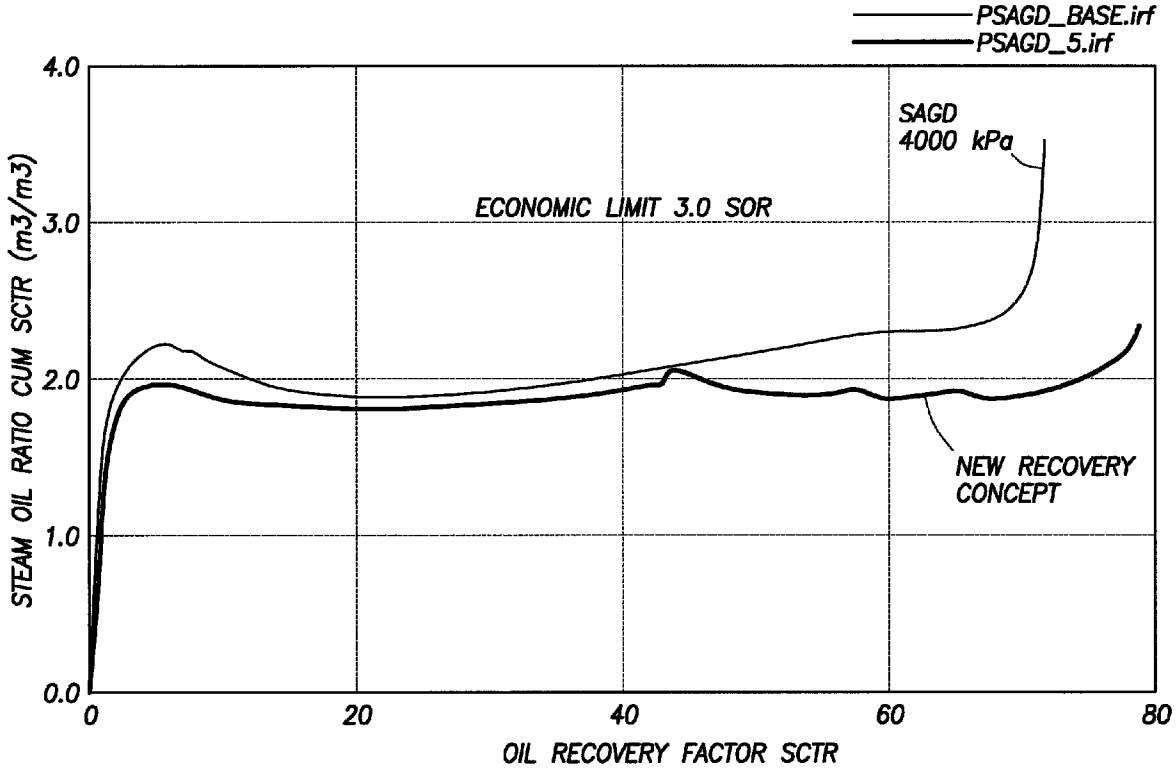
FIG. 3 is a steam-oil ratio versus oil factor graph of the example in FIG. 2.

The combination of steam drive and gravity drainage, as depicted in FIG. 2, along with the operating pressures, improves the steam-oil ratio performance as shown in FIG. 3. Specifically, FIG. 3 provides a comparison between the results depicted in FIG. 2 versus the standard well with a constant steam injection pressure of 4000 kPa.

Figure 4:
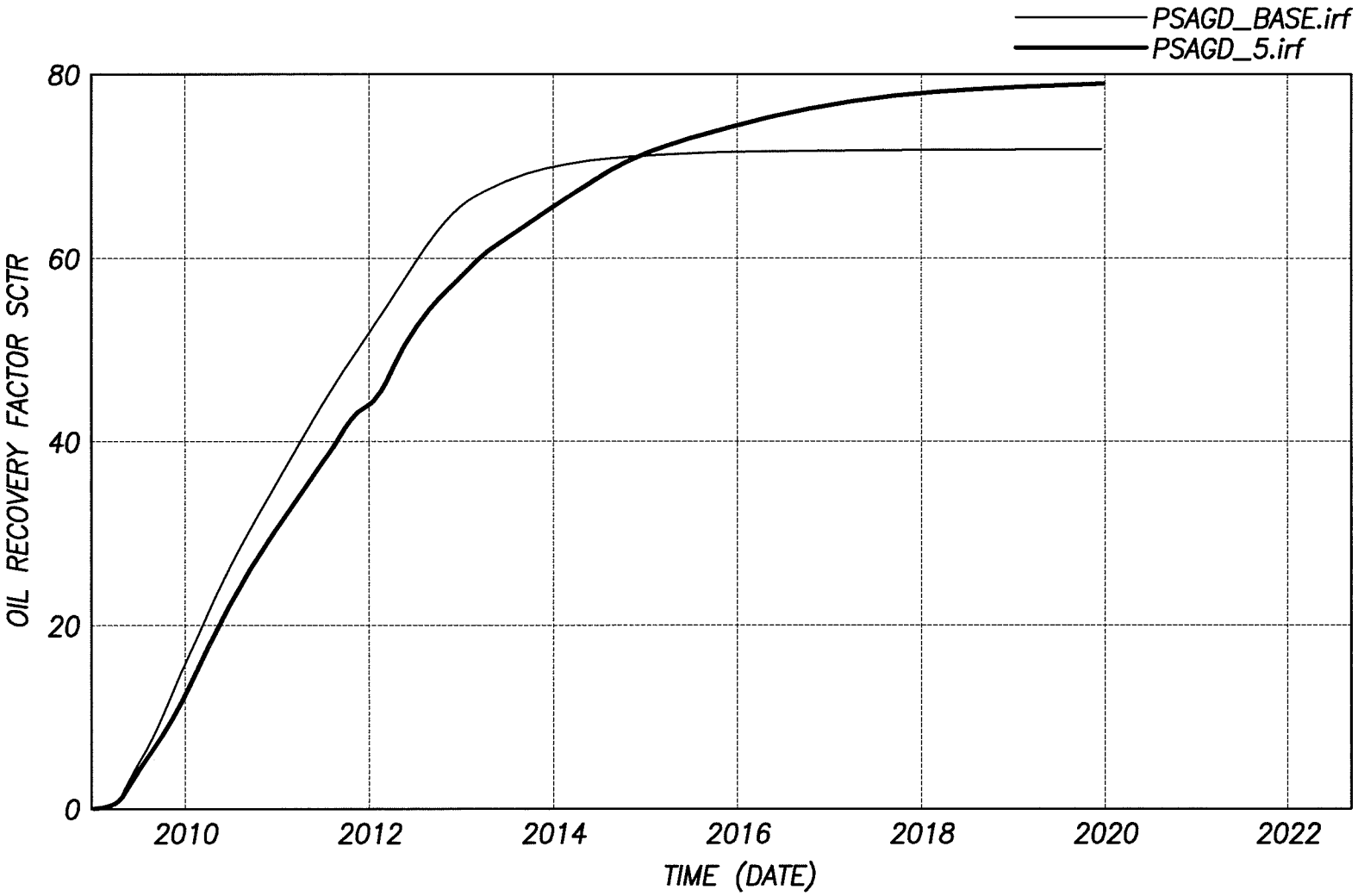
FIG. 4 is an oil recovery factor versus time graph of the example in FIG. 2.

FIG. 4 depicts the oil recovery factor of the results from FIG. 2 compared to standard well with a constant steam injection pressure of 4000 kPa. Specifically, FIG. 4 shows that the new recovery method obtains a higher recovery factor that conventional SAGD.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A method for producing hydrocarbons in a subterranean formation having at least two well pairs comprising:

a. installing a highest pressure well pair in the subterranean formation, wherein the highest pressure well pair includes a first injection well and a first production well, wherein the pressure differential across the first injection well and an adjacent injection well is at least 200 kPa;

b. installing a lowest pressure well pair in the subterranean formation, wherein the lowest pressure well pair includes a final injection well and a final production well, wherein the pressure differential across the final injection well and an adjacent injection well is at least 200 kPa;

c. applying a considerable pressure differential across the highest pressure well pair and the lowest pressure well pair, wherein the considerable pressure differential across the highest pressure and lowest pressure well pairs is at least 200 kPa;

d. injecting steam into the first injection well to form a first steam chamber;

e. injecting steam into the final injection well to form an adjacent steam chamber;

f. monitoring the steam chambers until they merge into a final steam chamber;

g. ceasing the flow of steam into the first injection well; and h. injecting steam into the final injection well to maintain the final steam chamber.

2. The method according to claim 1, wherein a solvent is co-injected with the steam.

3. The method according to claim 2, wherein the solvent is a non-condensable gas.

4. The method according to claim 3, wherein the non-condensable gas is selected from a group consisting of methane, nitrogen, carbon-dioxide, air, light hydrocarbons, or combinations thereof.

5. A method for producing hydrocarbons in a subterranean formation having at least two well pairs comprising:

a. installing a highest pressure well pair in the subterranean formation, wherein the highest pressure well pair includes a first injection well and a first production well;

b. installing a lowest pressure well pair in the subterranean formation, wherein the lowest pressure well pair includes a final injection well and a final production well;

c. applying a considerable pressure differential across the highest pressure well pair and the lowest pressure well pair;

d. injecting steam into the first injection well to form a first steam chamber;

e. injecting steam into the final injection well to form a final steam chamber;

f. monitoring the steam chambers until they merge into a final steam chamber;

g. ceasing the flow of steam into the first injection well; and h. injecting steam into the final injection well to maintain a final steam chamber.

6. The method according to claim 5, wherein a solvent is co-injected with the steam.

7. The method according to claim 6, wherein the solvent is a non-condensable gas.

8. The method according to claim 7, wherein the non-condensable gas is selected from a group consisting of methane, nitrogen, carbon-dioxide, air, light hydrocarbons, or combinations thereof.

9. The method according to claim 5, wherein the considerable pressure differential across the highest pressure and lowest pressure well pairs is at least 200 kPa.

10. The method according to claim 5, wherein the pressure differential across the first injection well and an adjacent injection well is at least 200 kPa.

11. The method according to claim 5, wherein the pressure differential across the final injection well and the an adjacent injection well is at least 200 kPa.

* * * * *